US009409072B2

(12) United States Patent
Staten et al.

(10) Patent No.: US 9,409,072 B2
(45) **Date of Patent: *Aug. 9, 2016**

(54) FOOTBALL SLED WITH BLOCKER PAD RANGE OF MOTION

(75) Inventors: Kenneth E. Staten, Clare, MI (US); Grant Rogers, Sanford, MI (US); Jacob Rogers, Sanford, MI (US); Kyle R. Camp, Clare, MI (US)

(73) Assignee: Rogers Athletic Company, Inc., Clare, MI (US)

( * ) Notice: Subject to any disclaimer, the term of this patent is extended or adjusted under 35 U.S.C. 154(b) by 1174 days.

This patent is subject to a terminal disclaimer.

(21) Appl. No.: 12/986,355

(22) Filed: Jan. 7, 2011

(65) Prior Publication Data

US 2012/0157244 A1 Jun. 21, 2012

Related U.S. Application Data

(63) Continuation-in-part of application No. 12/971,160, filed on Dec. 17, 2010, and a continuation-in-part of application No. 12/971,183, filed on Dec. 17, 2010.

(51) Int. Cl.

| | |
|---|---|
| ***A63B 69/00*** | (2006.01) |
| ***A63B 69/34*** | (2006.01) |
| ***A63B 21/00*** | (2006.01) |
| ***A63B 23/04*** | (2006.01) |
| *A63B 71/00* | (2006.01) |
| *A63B 71/02* | (2006.01) |

(52) U.S. Cl.

CPC ..... *A63B 69/345* (2013.01); *A63B 21/0004* (2013.01); *A63B 21/4047* (2015.10); *A63B 23/047* (2013.01); *A63B 2071/0063* (2013.01); *A63B 2071/026* (2013.01)

(58) Field of Classification Search

CPC ..... A63B 69/34

USPC ..... 473/465, 445, 444, 441, 415; 73/865.4; 463/4; 414/2; 273/350; 248/316.5; 206/523, 320, 192, 174

See application file for complete search history.

(56) References Cited

U.S. PATENT DOCUMENTS

| | | | | |
|---|---|---|---|---|
| 1,427,532 | A * | 8/1922 | Hambrock | 248/316.5 |
| 2,237,599 | A * | 4/1941 | Gilman | 473/444 |
| 2,558,081 | A * | 6/1951 | Gardenhour | 473/445 |
| 3,087,630 | A * | 4/1963 | Karnow et al. | 414/590 |
| 3,329,428 | A * | 7/1967 | Moran | 473/441 |
| 3,827,690 | A * | 8/1974 | Rogers | 473/445 |
| 7,056,238 | B1 * | 6/2006 | Brown | 473/444 |
| 2002/0147061 | A1 * | 10/2002 | Krause et al. | 473/445 |
| 2006/0100040 | A1 * | 5/2006 | Spencer | 473/441 |
| 2008/0051228 | A1 * | 2/2008 | Harmon et al. | 473/445 |
| 2011/0152013 | A1 * | 6/2011 | Staten et al. | 473/445 |
| 2011/0152014 | A1 * | 6/2011 | Staten et al. | 473/445 |
| 2011/0263354 | A1 * | 10/2011 | Rusch et al. | 473/445 |
| 2012/0157244 | A1 * | 6/2012 | Staten et al. | 473/445 |

* cited by examiner

*Primary Examiner* — Gene Kim

*Assistant Examiner* — M Chambers

(74) *Attorney, Agent, or Firm* — Carlson, Gaskey & Olds, P.C.

(57) ABSTRACT

A blocking sled includes a sled frame, an arm mounted to said sled frame and a blocking pad having at least one handhold mounted to the arm.

25 Claims, 9 Drawing Sheets

FOOTBALL SLED WITH BLOCKER PAD RANGE OF MOTION

The present disclosure is a continuation-in-part of U.S. patent application Ser. No. 12/971,160, filed Dec. 17, 2010 and is a continuation-in-part of U.S. patent application Ser. No. 12/971,183, filed Dec. 17, 2010.

BACKGROUND

The present disclosure relates to sports equipment, and more particularly to a football sled with a range of motion to simulate a blocker.

Football has continued to evolve into a faster more lateral movement game as the athletes get bigger, stronger, and more importantly, faster. Various types of football training equipment is used to allow players to practice their techniques without facing off against another live player.

A common example of such equipment is a football training sled for teaching fundamental and functional techniques such as tackling and blocking. A typical football sled includes a horizontal base, including one or more sled-like runners and a padded vertical extension mounted at one end of the sled base. The padded portion of the sled may be sized and shaped to represent an opposing player. A lineman may practice blocking techniques by blocking against the padded portion of the sled, driving the sled straight backwards as he would an opposing player.

SUMMARY

To train and develop more complex schemes and coordinated blocking assignments in Zone Blocking we have developed a blocker sled that provides a safe simulation thereof. As zone blocking requirements have teammates handling double teams, releasing to take on the next dangerous defender, the blocker sled disclosed herein can simulate the weight, resistance and natural movement of a defender.

Also, as football offense is now more complex, the defense must train to physically play the offender, as well as break through the blocker to take the seam, hence putting the defender in a position to attack or disrupt the ball carrier. The blocker sled disclosed herein moves like a blocker to allow the defender to work on shocking the offensive player, creating leverage and violently separating or attacking the offender.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
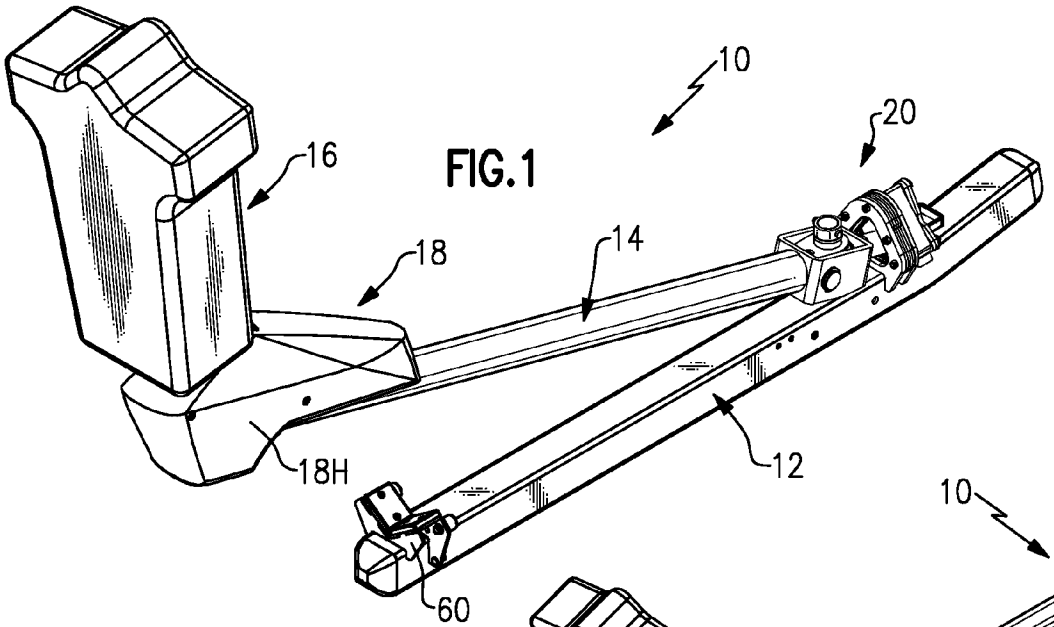
FIG. 1 is a perspective view of a football blocking sled.
Figure 2:
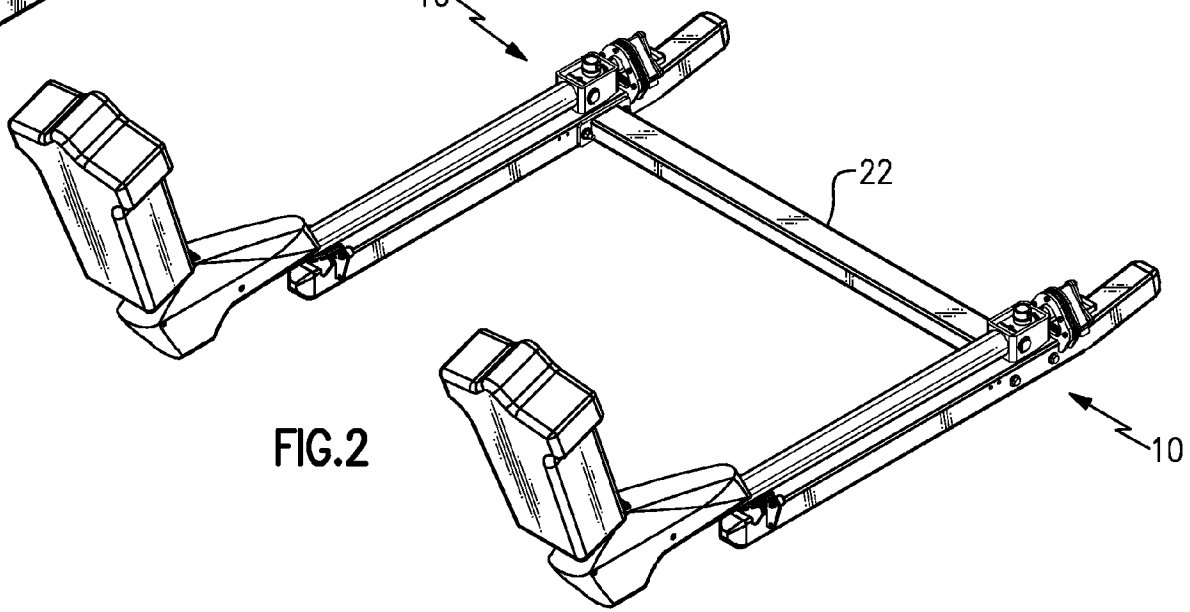
FIG. 2 is a perspective view of a multiple of football blocking sleds linked together.

FIG. 1 illustrates a football blocking sled 10 referred herein as the Tek Sled. The sled 10 generally includes a sled frame 12, an arm 14, a blocking pad 16, a damper arrangement 18 and a range of motion assembly 20. Although two sleds 10 are typically arranged together such as in the disclosed, non limiting embodiment, it should be understood that any number of sleds 10 may be connected together through a respective cross bar 22 to essentially represent a line of football players. That is, any number of sled frames 12 may be interconnected through respective cross bars 22 (FIG. 2) through bolting or other fastening arrangements.

Figure 3:
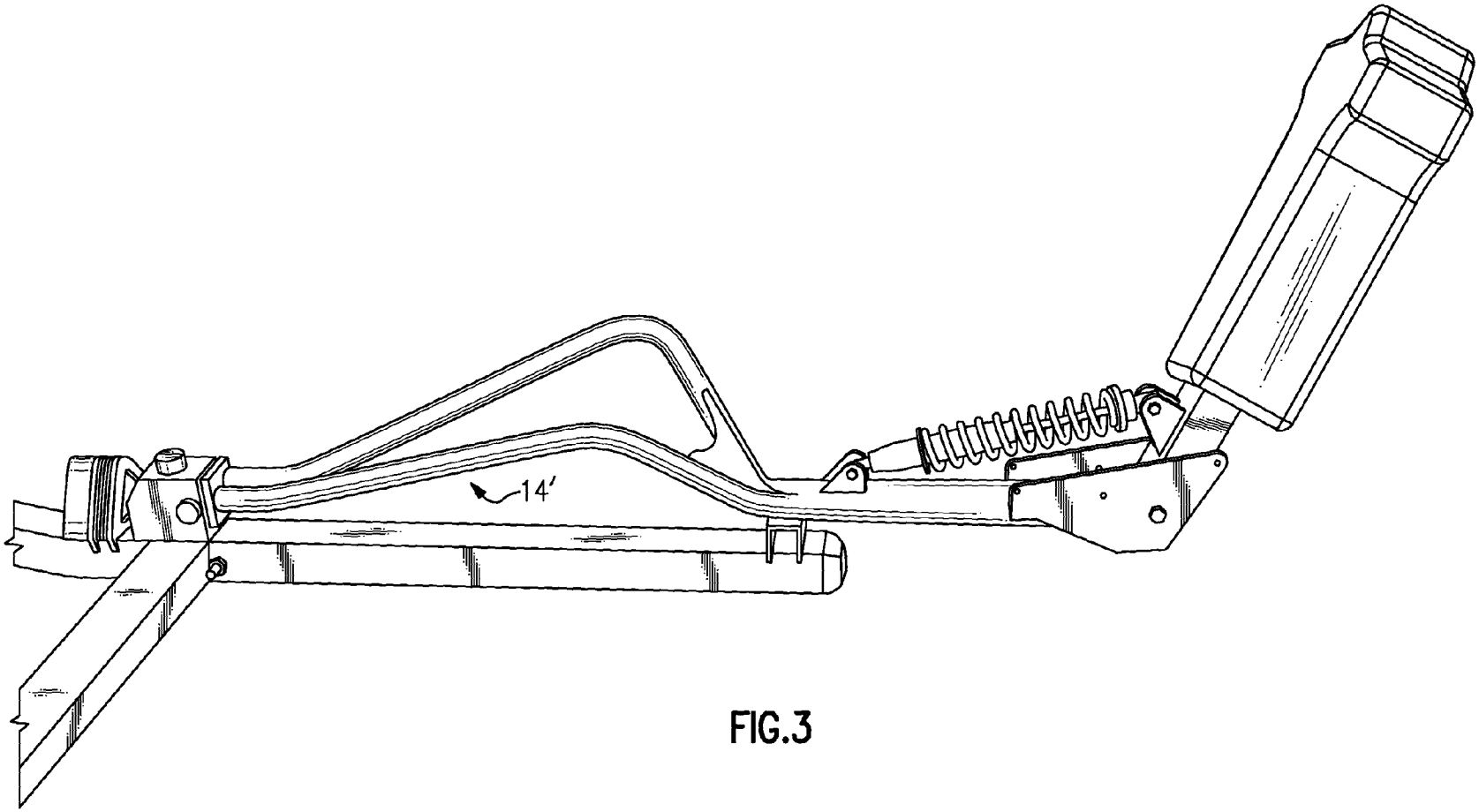
FIG. 3 is a perspective view of another non-limiting embodiment of an arm for a football blocking sled.

In one non-limiting embodiment, the arm 14 is a single tubular component, however, the arm 14 may alternatively be of various forms such as a split tube design 14' (FIG. 3). Such arrangements may facilitate movement of a player in a desired direction after engagement with the blocking pad 16.

Figure 4:
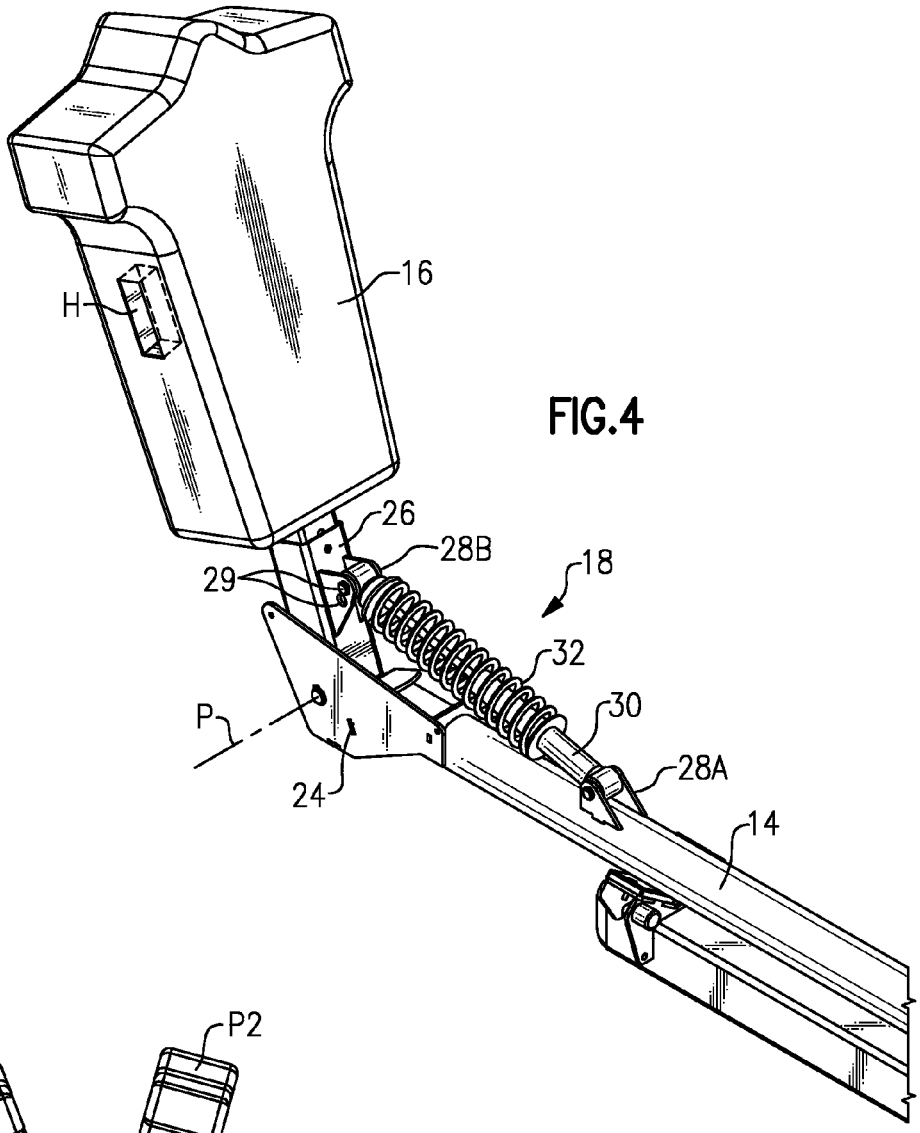
FIG. 4 is a perspective view of a damper assembly for the football blocking sled.

With reference to FIG. 4, the blocking pad 16 is attached to the arm 14 through the damper arrangement 18 which permits force application to the blocking pad 16 to also be absorbed by the damper arrangement 18. The blocking pad 16 is attached to the arm 14 at a pivot assembly 24 which defines an axis P between the arm 14 and a blocking pad socket 26 within the pivot assembly 24. That is, the blocking pad socket 26 and the blocking pad 16 removably mounted thereto pivots relative to the arm 14 about pivot axis P. It should be understood that various blocking pads 16 such as a blocking pad with handholds H may be adapted for receipt into the socket 26. For further understanding of other blocking pads, attention is directed to U.S. Pat. No. 7,056,238, entitled Hand-Held Offensive Lineman Training Pad which is assigned to the assignee of the instant disclosure and which is hereby incorporated herein in its entirety.

The damper arrangement 18 generally includes a mount 28A on the arm 14 and a mount 28B on the blocking pad socket 26. The mounts 28A, 28B locate the damper arrangement 18 to define a resistance to a force applied to the blocking pad 16 as the blocking pad 16 pivots through an arc defined by pad axis P. The damper arrangement 18 generally includes a shock 30 such as a hydraulic or pneumatic shock and a spring 32 which may be protected within a housing 18H (FIG. 1). Mount 28B may include a multiple of apertures 29 to calibrate an expected force, e.g., force applied by a high school player as compared to the force applied by a professional football player.

Figure 5:
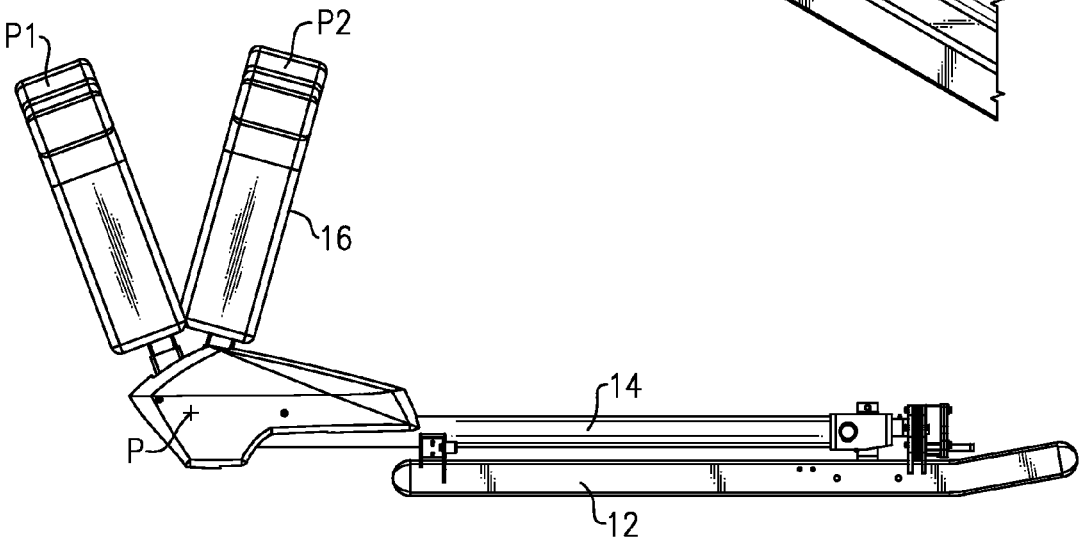
FIG. 5 is a schematic view of the range of motion of a blocker pad relative to an arm of the football blocking sled.

The arc of the blocking pad 16 in one disclosed non-limiting embodiment may be approximately 40 degrees (FIG. 5) in line with the arm 14. That is, the blocking pad 16 may pivot about the pad axis A between a forwardly canted position P1 and a rearwardly canted position P2. The damper arrangement 18 returns the blocking pad 16 to the forwardly canted position P1. It should be understood that various ranges of motion may alternatively or additionally be provided.

Figure 6B:
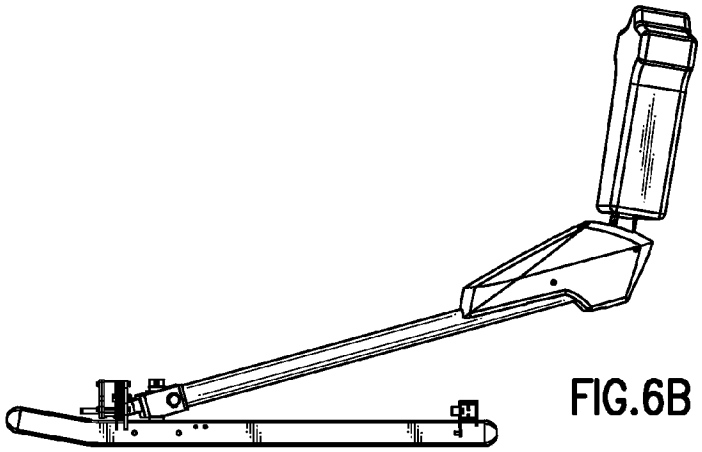
FIGS. 6A-6C are views of the range of motion of an arm of the football blocking sled which supports the blocking pad.
Figure 6C:
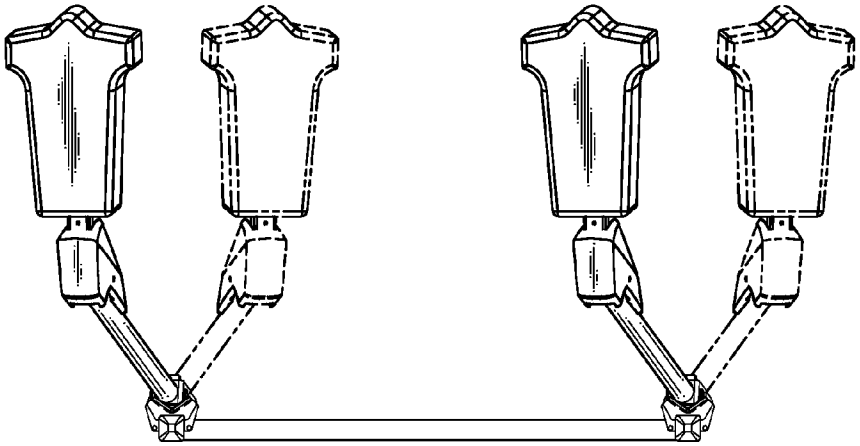
Figure 6A:
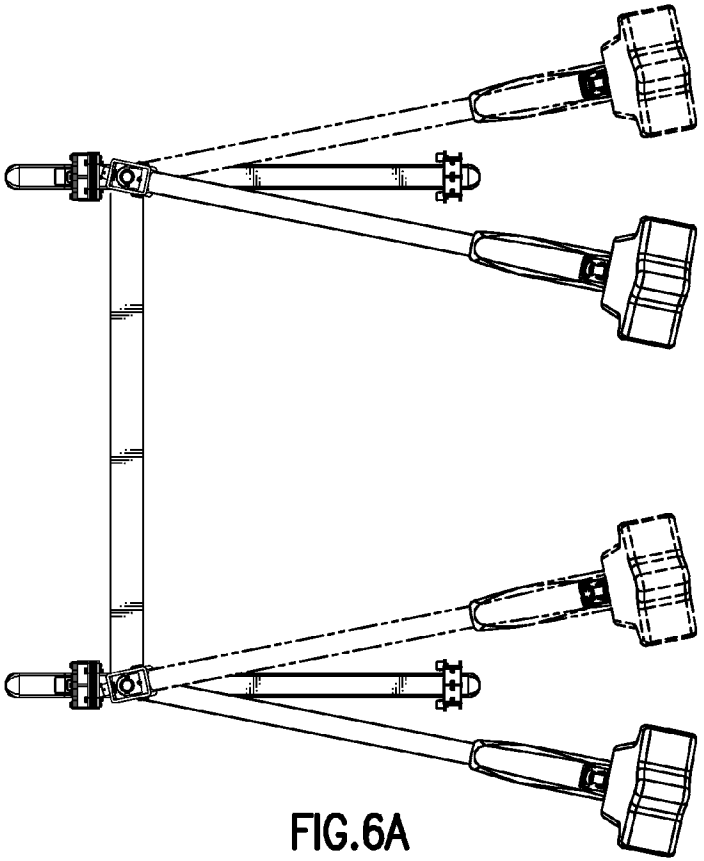

In addition to the motion of the blocking pad 16, the arm 14 supports the blocking pad 16 such that the entire arm 14 and blocking pad 16 may be moved through a range of motion relative to the sled frame 12 as controlled by the range of motion assembly 20. In one disclosed non-limiting embodiment, the range of motion assembly 20 provides a combination of lateral and vertical movement (FIGS. 6A-6C).

Figure 7:
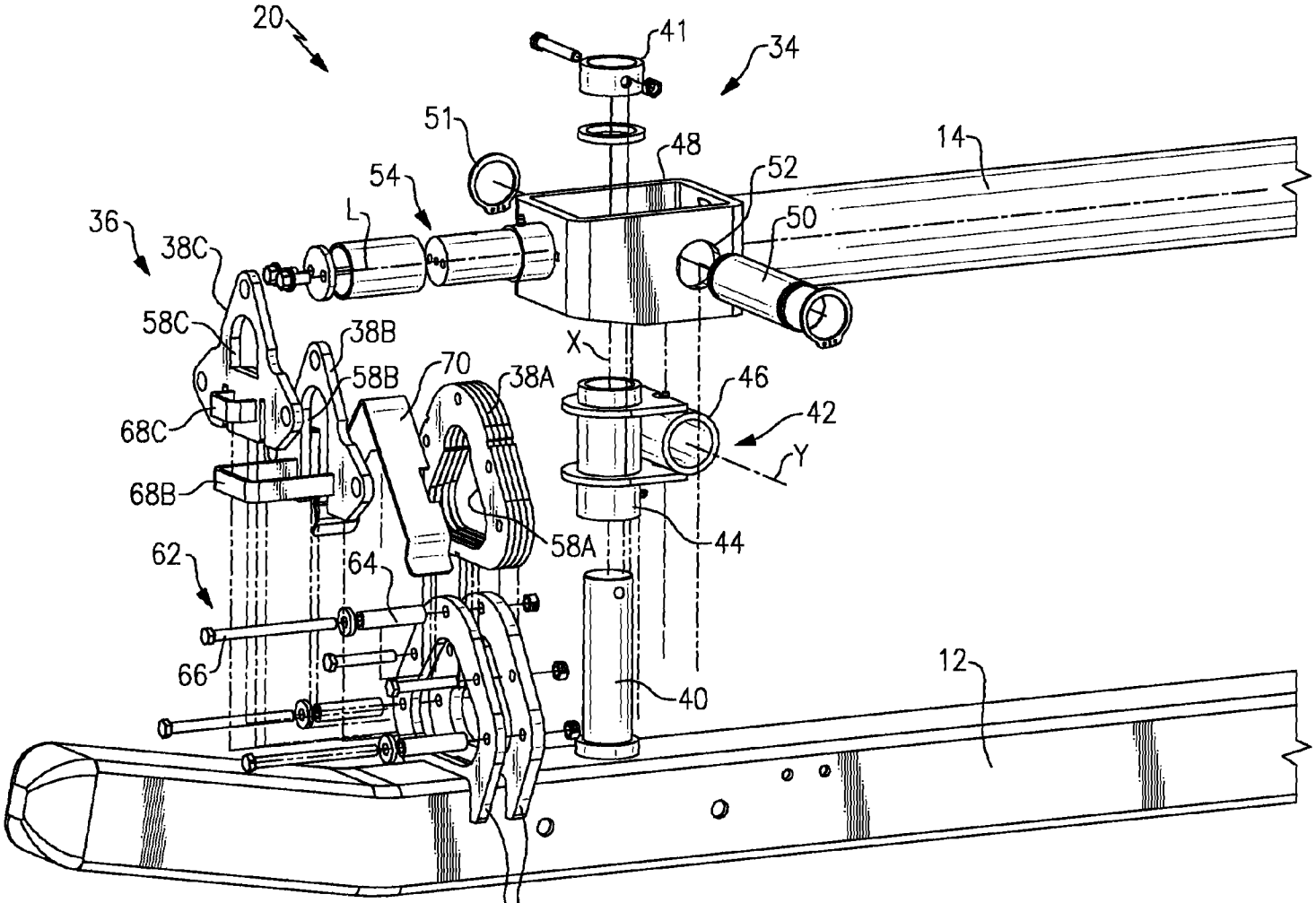
FIG. 7 is an exploded view of a range of motion assembly of the football blocking sled.

With reference to FIG. 7, the range of motion assembly 20 generally includes a pivot assembly 34 and a cartridge system 36. The pivot assembly 34 provides the lateral and vertical movement which may be selectively limited by the cartridge system 36 having a multiple of cartridge plates 38A, 38B and 38C. In one disclosed non-limiting embodiment, the cartridge plates 38A are axially fixed plates which define the full range of lateral and vertical movement relative to the sled frame 12; cartridge plate 38B permits, for example, only vertical movement relative to the sled frame 12; and cartridge plate 38C, for example, locks the arm 14 in a fixed position relative to the sled frame 12.

In one disclosed non-limiting embodiment, the pivot assembly 34 generally includes an axle 40 which extends from the sled frame 12 to receive a pivot joint 42. The pivot joint 42 includes a first cylinder 44 fixed to a second cylinder 46 in a transverse orientation. The first cylinder 44 defines a vertical axis X to permit lateral movement (FIG. 6A) of the arm 14 about axle 40 and the second cylinder 46 defines a horizontal axis X to permit vertical movement (FIG. 6B) of the arm 14. The first cylinder 44 is received upon axle 40 and may be retained thereon by a fastener assembly 41.

A pivot housing 48 attached to the end of the arm 14 receives the pivot joint 42 to support the arm 14 through a second axle 50. The second axle 50 is received through opposed apertures 52 in the pivot housing 48 and the second cylinder 46 of the pivot joint 42. The second axle 50 is retained therein by retaining rings 51.

A cam 54 extends from the housing 48 generally along an axis L defined by the arm 14. The cam 54 may be a cylindrical member which engages the cartridge system 36. The multiple of cartridge plates 38A, 38B and 38C operate as a cam surface to receive cam 54 and thereby constrain movement of the arm 14.

The cartridge system 36 is mounted to the sled frame 12 adjacent to the pivot assembly 34 for interaction therewith. Mount plates 56 are fixed to the sled frame 12 through welding or the like to receive cartridge plate 38A therebetween. That is, the mount plates 56 provide a fixed structure to support the cartridge system 36 directly adjacent the pivot assembly 34. The mount plates 56 are generally annular triangular shaped members which provide a significant range of motion greater than any cartridge plate 38A, 38B, 38C.

Figure 8A:
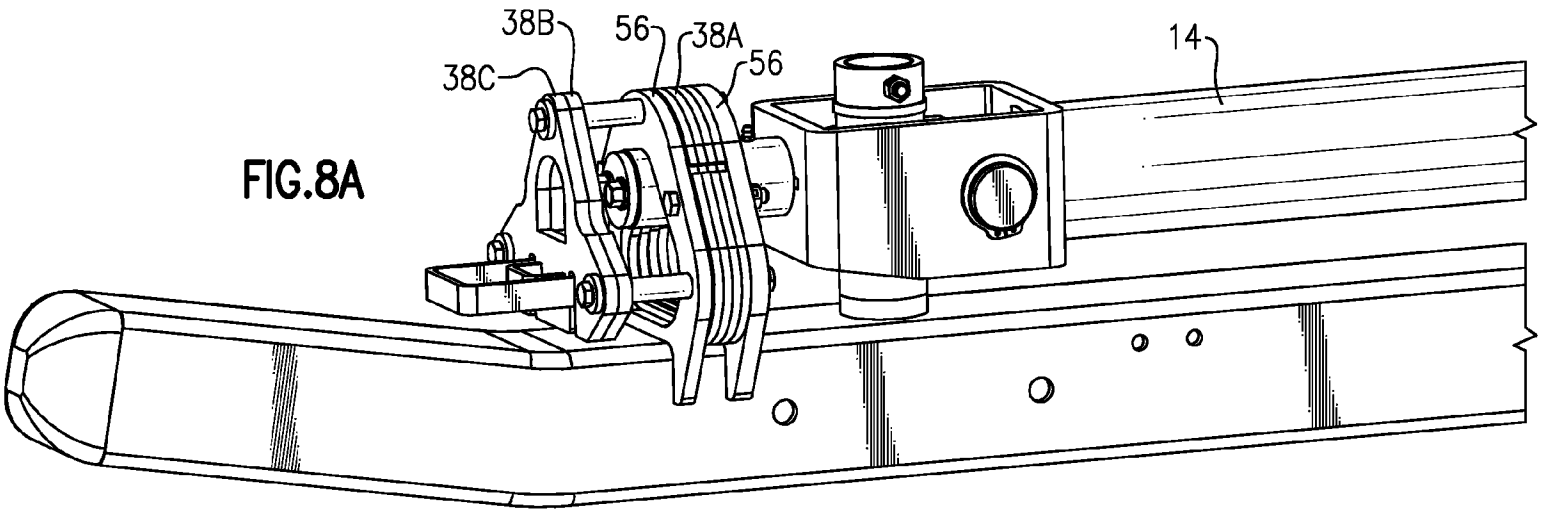
FIG. 8A is a perspective view of a cartridge system of the range of motion assembly of the football blocking sled, the cartridge system having a first cartridge plate which provides a full range of motion.

The cartridge plate 38A is selectively mounted between the mount plates 56 to define the primary range of motion through an aperture 58A. The aperture 58A is generally triangular in shape in the disclosed non-limiting embodiment (FIG. 8A). The shape of the aperture 58A guides the arm 14 so that upon release, for example, from a laterally displaced and lifted position, the arm 14 is guided back to a support 60 mounted to the sled frame 12 (FIG. 1). That is, the generally triangular shape of the aperture 58A defines the full range of lateral and vertical movement (FIGS. 6A-6C) relative to the sled frame 12 and inherently returns the arm 14 to rest position onto support 60. Various other aperture shapes may alternatively be provided to define a desired range of motion for arm 14. That is, the shape of the aperture 58A controls the overall envelope of motion of arm 14 relative to sled frame 12. As illustrated in one disclosed non-limiting embodiment, the cartridge plate 38A may be a multiple of identical plates between mount plates 56 to assure a robust cam surface for the cam 54, however, a relatively thicker single cartridge plate may alternatively or additionally be provided.

The cartridge plates 38B, 38C are axially slidably mounted on standoffs 62 which extend from the mount plates 56 (also illustrated in FIG. 8A). The standoffs 62 may be arranged in a triangular pattern and include sleeves 64 supported upon bolts 66. The cartridge plates 38B, 38C may include handles 68B, 68C to facilitate sliding movement thereof.

Figure 8B:
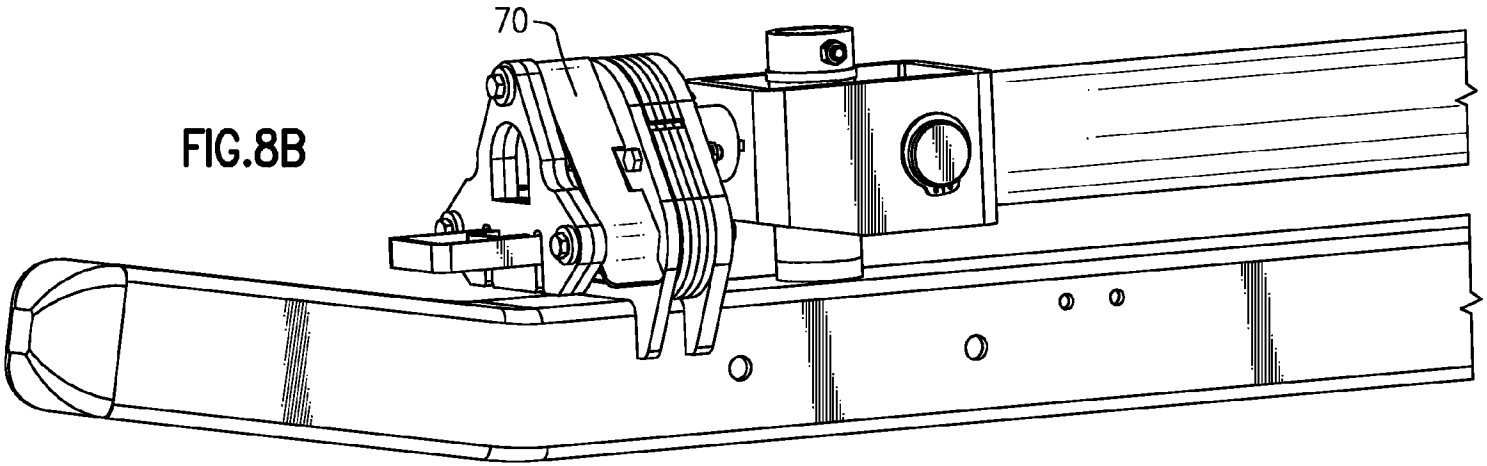
FIG. 8B is a perspective view of a cartridge system in the FIG. 8A position with a lock plate installed.

A removable lock 70 may be snapped onto the standoffs 62 between one of the mount plates 56 and the cartridge plate 38B, 38C to axially retain the cartridge plate 38B, 38C and assure that the generally triangular aperture 58A is the only aperture engaged with the cam 54 (FIG. 8B) to permit the full range of motion. It should be understood that the pivot assembly 34 typically provides a greater range of motion restricted only by the cartridge plate 38A.

Figure 9A:
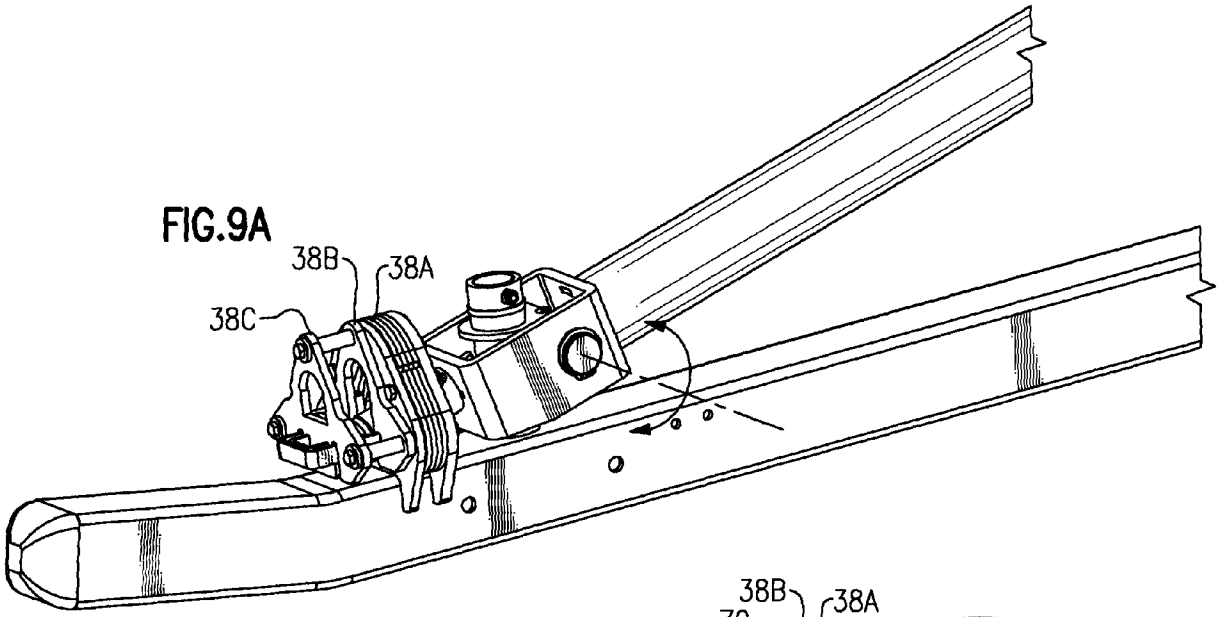
FIG. 9A is a perspective view of a cartridge system of the range of motion assembly of the football blocking sled, the cartridge system having a second cartridge plate positioned to provides a vertical range of motion of the arm relative to the sled frame.
Figure 9B:
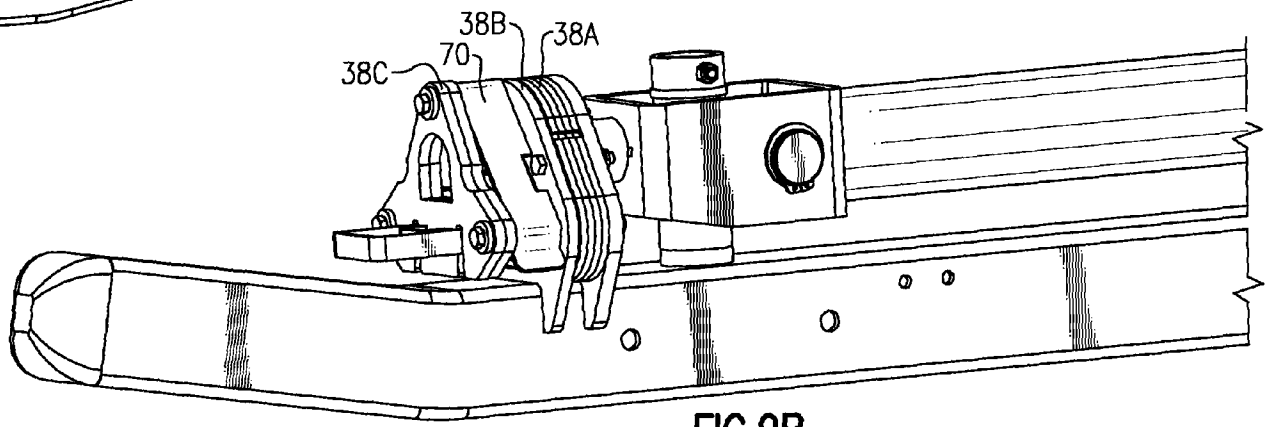
FIG. 9B is a perspective view of a cartridge system in the FIG. 9A position with a lock plate installed.

The cartridge plate 38B includes a generally rectilinear aperture 58B. The shape of the aperture 58B restricts movement of the arm 14 to permit, for example, only vertical movement relative to the sled frame 12. That is, when the cartridge plate 38B is slid along the standoffs 62 to be directly adjacent cartridge plate 38A the generally rectilinear aperture 58B is engaged with the cam 54 to supersede the constraint otherwise provided by aperture 58A (FIG. 9A). The removable lock 70 may be snapped onto the standoffs 62 between the cartridge plate 38B and cartridge plate 38C to axially retain the cartridge plate 38B and assure that generally rectilinear aperture 58B is engaged with the cam 54 (FIG. 9B).

Figure 10A:
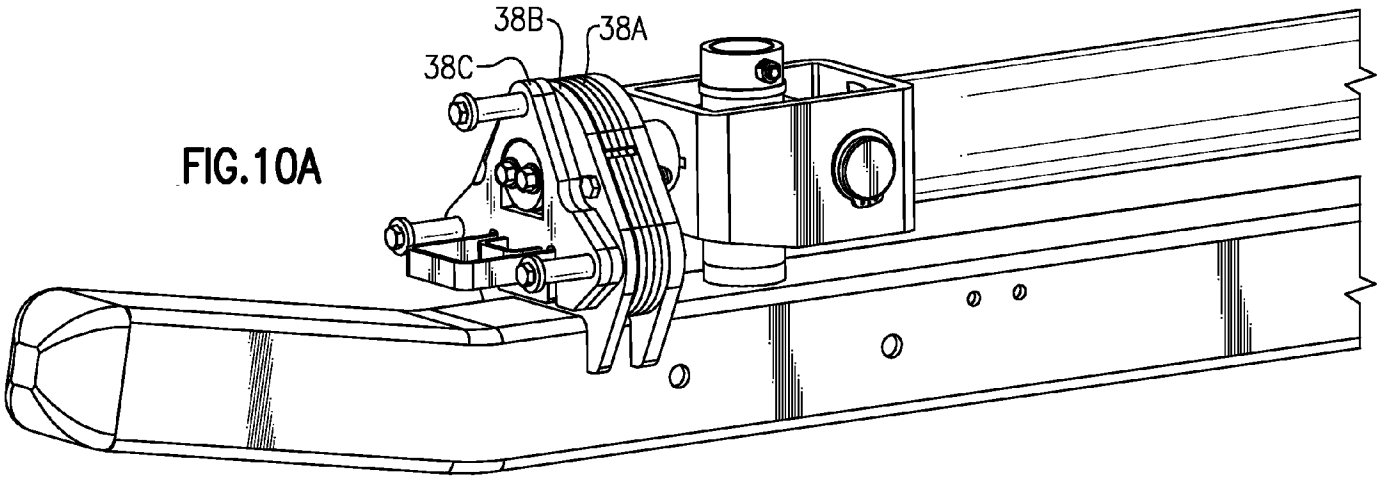
FIG. 10A is a perspective view of a cartridge system of the range of motion assembly of the football blocking sled, the cartridge system having a third cartridge plate positioned to lock the arm relative to the sled frame.
Figure 10B:
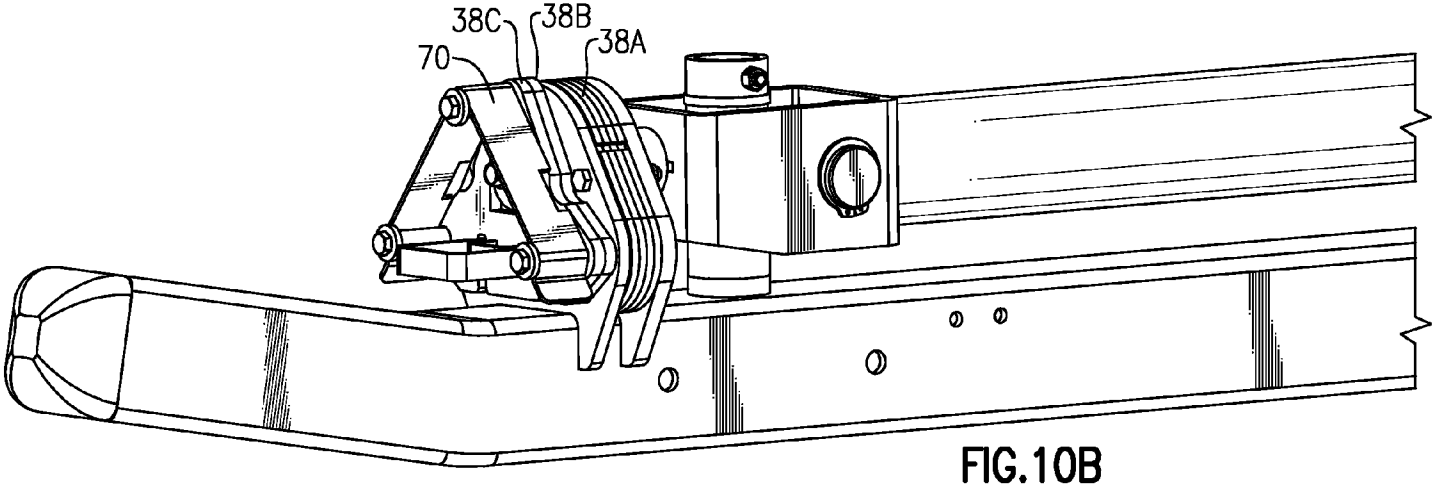
FIG. 10B is a perspective view of a cartridge system in the FIG. 10A position with a lock plate installed.

The cartridge plate 38C includes an aperture 58C which is sized to be generally equivalent to the shape of the cam 54. The shape of the aperture 58C thereby locks the arm 14 in a fixed position relative to the sled frame 12 when the cartridge plate 38C is slid adjacent to the cartridge plate 38B (FIG. 10A). That is, the more limited aperture 58C engages the cam 54 and supersedes aperture 38B. The removable lock 70 may then be snapped onto the standoffs 62 between the cartridge plate 38C and flanged ends of the stand off 62 to axially retain the cartridge plate 38C and assure that aperture 58C is engaged with the cam 54 (FIG. 10B).

It should be understood that alternative or additional cartridge plates with various other aperture shapes may be provided to further define a desired range of motion for arm 14. That is, the shape of the aperture 58 controls the envelope of motion of arm 14 relative to sled frame 12 to provide, for example movement to but one lateral side relative to the sled frame 12.

Figure 11:
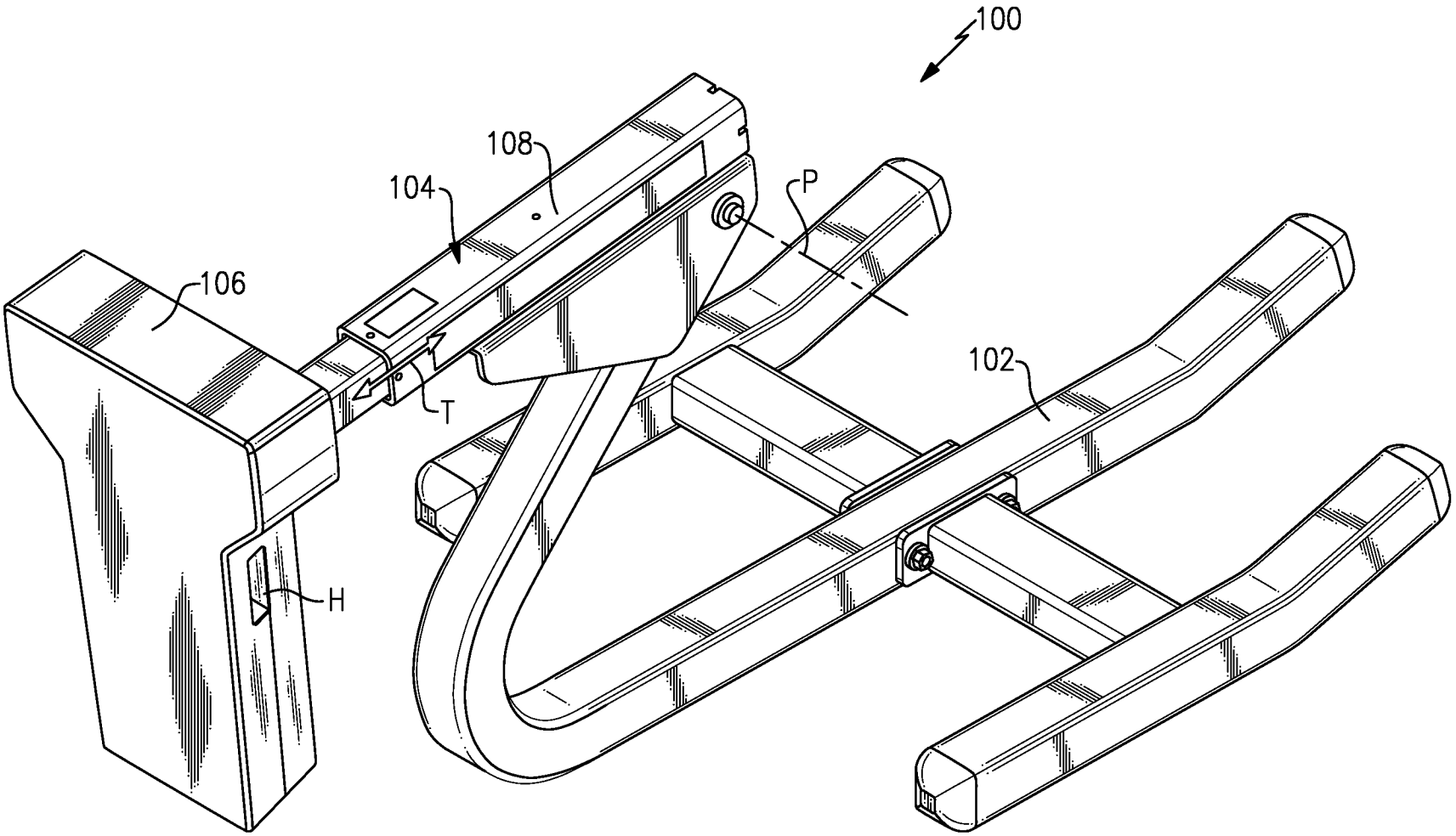
FIG. 11 a perspective view of another non-limiting embodiment of a football blocking sled.

With reference to FIG. 11, another football blocking sled 100 includes a sled frame 102, an arm 104, a blocking pad 106, a damper arrangement 108 and a range of motion assembly 120. The blocking pad 106 includes handholds H as discussed above.

The blocking pad 106 is attached to the arm 104 through the damper arrangement 108 which permits force application to the blocking pad 106 to be absorbed axially along the arm

104 along axis T prior to movement though the range of motion assembly 120 about axis P. That is, the football blocking sled 100 requires movement of the blocking pad 106 telescopically for a predetermined distance along arrow T such as five (5) inches to be absorbed telescopically along the arm 104 along axis T prior to rotation about axis P. The damper arrangement 108 may include a shock such as a hydraulic or pneumatic shock and a spring (not shown) within the arm 104. The range of motion assembly 120 may include a cartridge system 36 as described above or other lock arrangement which interacts with the damper arrangement 108 to prevent rotation about axis P until the predetermined axial distance is first achieved.

A player must first overcome the resistance of the damper arrangement 108 prior to the blocking pad 106 being movable about the axis P to teaches the player to roll the hips and lift the blocking pad 106 to simulate finishing off the opponent.

Alternatively, the range of motion assembly 120 may be locked out such that the lifting action about axis P is prevented. This facilitates the practice of base and drive blocking.

The handholds H facilitate such training as the player may readily grab the blocking pad 106 in a manner typical of grabbing an opponent.

It should be understood that various other movable or fixed sled arrangements will benefit from the blocking pad 106 with handholds H as discussed above.

It should be understood that relative positional terms such as "forward," "aft," "upper," "lower," "above," "below," and the like are with reference to the normal operational attitude of the vehicle and should not be considered otherwise limiting.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A blocking sled comprising:

a sled frame;

an arm mounted to said sled frame, said arm extending longitudinally from said sled frame in a direction along a longitudinal axis; and a blocking pad having at least one handhold mounted to said arm, said blocking pad facing in the direction of the longitudinal axis, wherein said blocking pad is movable in a lateral direction relative to said sled frame, wherein said arm is movable in a vertical direction relative to said sled frame, said arm secured to a rear portion of said sled frame and engaging said blocking pad near a forward portion of said sled frame.

2. The blocking sled as recited in claim 1, wherein said blocking pad is pivotable through an arc defined about a pad axis.

3. The blocking sled as recited in claim 2, wherein said pad axis is transverse to said arm.

4. The blocking sled as recited in claim 2, wherein said blocking pad arc is movable between a forwardly canted position and a rearwardly canted position relative to said arm.

5. The blocking sled as recited in claim 1, further comprising a damper assembly between said blocking pad and said arm.

6. The blocking sled as recited in claim 1, wherein said arm is movable in a vertical direction relative to said sled frame.

7. The blocking sled as recited in claim 1, wherein said arm is movable in a vertical direction and a lateral direction relative to said sled frame.

8. The blocking sled as recited in claim 1, wherein a majority of said blocking pad is positioned vertically above said arm.

9. The blocking sled as recited in claim 1, wherein said blocking pad is positioned along the longitudinal axis further from said sled frame than any portion of said arm.

10. The blocking sled as recited in claim 1, wherein a primary contact surface of said blocking pad faces in the direction, the primary contact surface configured to be contacted by an athlete to move said blocking pad from a starting position where said arm is aligned with said sled frame.

11. A blocking sled comprising:

a sled frame;

a pivot assembly mounted to said sled frame;

an arm mounted to said pivot assembly, said arm movable relative to said sled frame through said pivot assembly, said arm extending longitudinally from said sled frame in a direction along a longitudinal axis;

a blocking pad movable relative to said arm, said blocking pad having at least one handhold, a primary contact surface of said blocking pad facing in the direction of the longitudinal axis; and a damper assembly between said blocking pad and said arm.

12. The blocking sled as recited in claim 11, wherein said blocking pad is pivotable through an arc defined about a pad axis.

13. The blocking sled as recited in claim 12, wherein said blocking pad arc is movable between a forwardly canted position and a rearwardly canted position relative to said arm.

14. The blocking sled as recited in claim 11, further comprising a mount on the arm and a mount on the blocking pad, said damper assembly adjustably positionable between said mounts.

15. The blocking pad as recited in claim 11, wherein said blocking pad is positioned vertically above said arm.

16. A blocking sled comprising:

a sled frame;

a pivot assembly mounted to said sled frame;

an arm mounted to said pivot assembly, said arm movable relative to said sled frame through said pivot assembly, said arm extending longitudinally from said sled frame in a direction along a longitudinal axis;

a blocking pad movable relative to said arm, said blocking pad having at least one handhold, a primary contact surface of said blocking pad facing in the direction of the longitudinal axis; and wherein said arm is constrained in movement through a cartridge assembly.

17. The blocking sled as recited in claim 16, wherein said cartridge assembly includes a multiple of cartridge plates, each of said cartridge plates engageable with said arm to selectively constrain movement of said arm.

18. The blocking sled as recited in claim 17, wherein one of said multiple of cartridge plates restricts movement of said arm to movement in a vertical direction relative to said sled frame.

19. The blocking sled as recited in claim 17, wherein one of said multiple of cartridge plates restricts movement of said arm to movement in a vertical direction and a lateral direction relative to said sled frame.

20. The blocking sled as recited in claim 17, wherein one of said multiple of cartridge plates fixes said arm relative to said sled frame.

21. A blocking sled comprising:

an arm extending longitudinally in a direction along a longitudinal axis;

a blocking pad having at least one handhold, said blocking pad having a primary contact surface facing in the direction of the longitudinal axis; and a damper assembly between said blocking pad and said arm, said blocking pad movable relative to said arm.

22. The blocking sled as recited in claim 21, wherein said arm is movable relative to a sled frame through a pivot assembly.

23. The blocking sled as recited in claim 21, wherein said arm is fixed to a sled frame.

24. The blocking sled as recited in claim 21, wherein said arm engages a downwardly facing surface of said blocking pad.

25. An athlete training device for use in teaching football blocking techniques comprising:

a horizontal ground engaging blocking sled base having a front end and a rear end; and a horizontal arm having a front end and a rear end rigidly mounted on said base towards a rear end of said blocking sled base and wherein said arm is essentially parallel to said blocking sled base and vertically higher than said blocking sled base when in a starting position and wherein said arm is pivotably moveable in a vertical and transverse direction to said blocking sled base and a blocking assembly at the front end of said arm, wherein said blocking assembly is comprised of a blocking pad pivotable through an arc defined about a pad axis that is transverse to said arm and having a damper assembly between said arm and said blocking pad, said blocking pad including at least one handhold.

* * * * *